US005540882A

United States Patent [19]

Billgren

[11] Patent Number: 5,540,882

[45] Date of Patent: Jul. 30, 1996

[54] METHOD RELATING TO POWDER METALLURGICAL MANUFACTURING OF A BODY

[75] Inventor: Per Billgren, Söderfors, Sweden

[73] Assignee: Erasteel Kloster Aktiebolag, Soderfors, Sweden

[21] Appl. No.: 411,787

[22] PCT Filed: Oct. 26, 1993

[86] PCT No.: PCT/SE93/00873

§ 371 Date: Apr. 7, 1995

§ 102(e) Date: Apr. 7, 1995

[87] PCT Pub. No.: WO94/11140

PCT Pub. Date: May 26, 1994

[30] Foreign Application Priority Data

Nov. 16, 1992 [SE] Sweden ..... 9203414

[51] Int. Cl.[6] ..... B22F 3/14

[52] U.S. Cl. ..... 419/8; 419/49

[58] Field of Search ..... 419/5, 8, 49

[56] References Cited

U.S. PATENT DOCUMENTS

| | | | |
|---|---|---|---|
| 3,992,202 | 11/1976 | Dulis et al. | 75/222 |
| 3,996,048 | 12/1976 | Fiedler | 75/208 R |
| 4,094,672 | 6/1978 | Fleck et al. | 75/226 |
| 4,976,915 | 12/1990 | Kuroki | 419/8 |
| 5,154,882 | 10/1992 | Zick | 419/49 |
| 5,403,670 | 4/1995 | Ohsue et al. | 428/564 |
| 5,435,965 | 7/1995 | Mashima et al. | 419/8 |

*Primary Examiner*—Donald P. Walsh
*Assistant Examiner*—Daniel J. Jenkins
*Attorney, Agent, or Firm*—Michael D. Bednarek; Marks & Murase L.L.P.

[57] ABSTRACT

The invention concerns a method relating to powder metallurgical manufacturing of a body having a through hole, for example a hollowed tool blank or thick-walled tube. The characteristic feature of the method is that in an outer capsule there is provided a tube (6) having substantially the same length as the capsule, so that the tube extends substantially through the entire length of the capsule, that in the tube there is provided a core (5) which also extends through the capsule and the entire length of the tube, that the space between the tube (6) and the inner side of the capsule (1) is filled with a metal powder (9) which shall form the desired body, that the space (10) in the tube (6) between the core (5) and the inner side of the tube is filled with a non-metallic powder (11), that the capsule is closed hermetically, and that the closed capsule and its content is subjected to hot isostatic compaction at a temperature exceeding 1000 C., so that the metal powder is compacted to complete density.

9 Claims, 1 Drawing Sheet

METHOD RELATING TO POWDER METALLURGICAL MANUFACTURING OF A BODY

BACKGROUND OF THE INVENTION

1. Field of the Invention

. The present invention concerns a method relating to powder metallurgical manufacturing of a body having a through hole, for example a hollowed tool blank or a thick-walled tube.

2. Discussion of Related Art

Hollowed tool blanks of high speed steels, hot or cold work steels, or advanced construction steels are used to a considerable extent for the production of various finished products. Examples of such products are cutting tools having a shaft, e.g. cutters, tool dies, linings in extrusion presses, gears and other machine elements. Among other technical fields may be mentioned the arms industry, where hollowed blanks can be used for the manufacturing of gun barrels.

The manufacturing of blanks by boring an urnhollowed working-piece is a costly task, particularly when it is the question of materials which are difficult to work by cutting operations, such as high speed steels and other tool steels, advanced construction materials, etc, whether the working-piece has been made powder metallurgically or by conventional production. Traditional powder metallurgical manufacturing by making a green body, which is subjected to subsequent sintering and working offers good opportunities of manufacturing hollowed blanks, while the manufacturing of hollowed blanks by hot isostatic compaction of metal powder implies substantially greater practical problems. It is true that it is possible to enclose the powder in a tube-shaped capsule, which is subjected to hot isostatic compaction, but the manufacturing and welding of such capsules is comparatively complicated and makes the manufacturing considerably more expensive.

It is also possible to provide a core in the capsule which is filled with metal powder and which is subjected to a subsequent hot isostatic compaction, whereafter the core can be removed after completed consolidation of the metal powder by hot isostatic compaction. The difficulty lies in the removal of the core, which integrates itself with the consolidated body which is formed of the metal powder at the hot isostatic compaction.

SUMMARY OF THE INVENTION

The overall object of the present invention is to solve this problem, which is possible by providing in an outer capsule a tube having substantially the same length as the capsule, so that the tube extends substantially through the entire length of the capsule, that in the tube there is provided a core which also extends through the capsule and the entire length of the tube, that the space between the tube and the inner side of the capsule is filled with a metal powder which shall form the desired body, that the space in the tube between the core and the inner side of the tube is filled with a non-metallic powder, that the capsule is closed hermetically, and that the closed capsule and its content is subjected to hot isostatic compaction at a temperature exceeding 1000°, so that the metal powder is compacted to complete (true) density. The invention herein resides on the principle to obtain a release agent from the non-metallic powder between the consolidated metal body and the core in spite of the fact that the non-metallic powder in the space between the core and the inner side of the tube is consolidated to a substantially dense material during the hot isostatic compaction, so that it can transfer the isostatic pressure, which is applied on the outer side of the capsule, to the core via the metal powder which is being compacted to true density. This, according to an aspect of the invention, can be achieved so that the hot isostatically compacted capsule with its content, possibly alter a subsequent hot treatment through forging and/or rolling, is cooled to room temperature or at least to a temperature at which the object can be practically handled, i.e. below 100° C. wherein the substantially dense material which has been formed through the consolidation of the said non-metallic powder during the hot isostatic compaction is caused to deconsolidate, i.e. to be fragmented and/or return to the shape of powder.

A method of effecting the deconsolidation of the consolidated non-metallic material is based on the selection of the non-metallic powder among the group of materials which spontaneously are fragmented because of phase transformation when cooling the material from a temperature above 1000° C. to room temperature, which phase transformation will cause so great internal stresses in the material that they lead to the fragmentation. When cooling the integrated body, which during the hot isostatic compaction has been formed by the metal powder, the tube, the non-metallic powder, and the core, the consolidated, non-metallic material, which has been formed of the non-metallic powder, thus will be deconsolidated through its inherent tendency to be spontaneously fragmented in situ in the closed space between the core and the tube, which on the other side is supported by the consolidated body which has been formed of the metal powder.

The non-metallic material thus shall be selected among the type of materials which on one hand can be consolidated to a substantially dense body through isostatic compaction at a temperature above 1000° C., and on the other hand be fragmented through cooling from a temperature above 1000° C. to room temperature. The inventor for the time being only knows one non-metallic powder having these features, namely dicalcium silicate, $Ca_2SiO_4$, which sometimes also is referred to as calcium ortosilicate, $(CaO)_2SiO_2$. The inventor, however, does not exclude that there may exist more non-metallic materials which satisfy the said conditions. Also the use of these material in that case is included by the invention.

As far as the calcium silicate, $Ca_2SiO_4$, is concerned, a phase transformation occurs at the cooling at about 600° C., which gives the material a powerful tendency to increase its volume. Herein so strong internal stresses are generated in the material that the material is spontaneously fragmented and more or less readopts its original powder shape. However, it cannot be excluded that also materials having a considerable tendency to shrink because of phase transformation during cooling within the temperature region from 1000° C. to room temperature in a corresponding way can be fragmented because of internal stresses. Also such materials in principle can be used according to the invention.

The tube which is arranged in the capsule and which surrounds the core at a distance from the core principally can consist of many conceivable materials. Normally a thin-walled tube made of metal sheet, suitably steel, is used. Also a sleeve which completely or partly consists of paper board can be conceived. Also a glass tube is conceivable, although glass for practical reasons may be less suitable.

In order to secure the core and the surrounding tube at the desired location in the capsule, usually centring the core and the tube in the capsule, suitable securing and centering means, respectively, can be provided. For example, the capsule bottom and the capsule lid may be provided with projections and/or recesses which can function as securing and centerings aids, respectively. As an alternative or as a complement thereto it is also conceivable to use tings having a thickness in the radial direction corresponding to the breadth of the desired gap between the core and the tube, which rings are united with the inner side of the capsule bottom and the capsule lid through welding, gluing, soldering, or in any other suitable way.

As the invention aims at the manufacturing of hollowed blanks of advanced materials, the metal powder usually consists of a steel powder, preferably a powder of alloyed steel, such as high speed steel, hot or cold work steel, stainless steel, or of a refractory material, for example a cobalt or nickel base alloy.

The core for example can consist of a steel rod of a conventional construction steel, but also other homogeneous materials which do not melt at the HIP-ing temperature and which are not crushed during the HIP-ing operation are conceivable. Thus, it is conceivable to use also a core made of any ceramic material, although a rod made of a simple construction steel is good enough.

BRIEF DESCRIPTION OF THE DRAWING

An embodiment of the invention will be explained more in detail with reference to the accompanying drawing (FIG. 1) which shows a longitudinal section through a filled capsule prior to compaction.

DESCRIPTION OF THE PREFERRED EMBODIMENT

Figure 1:
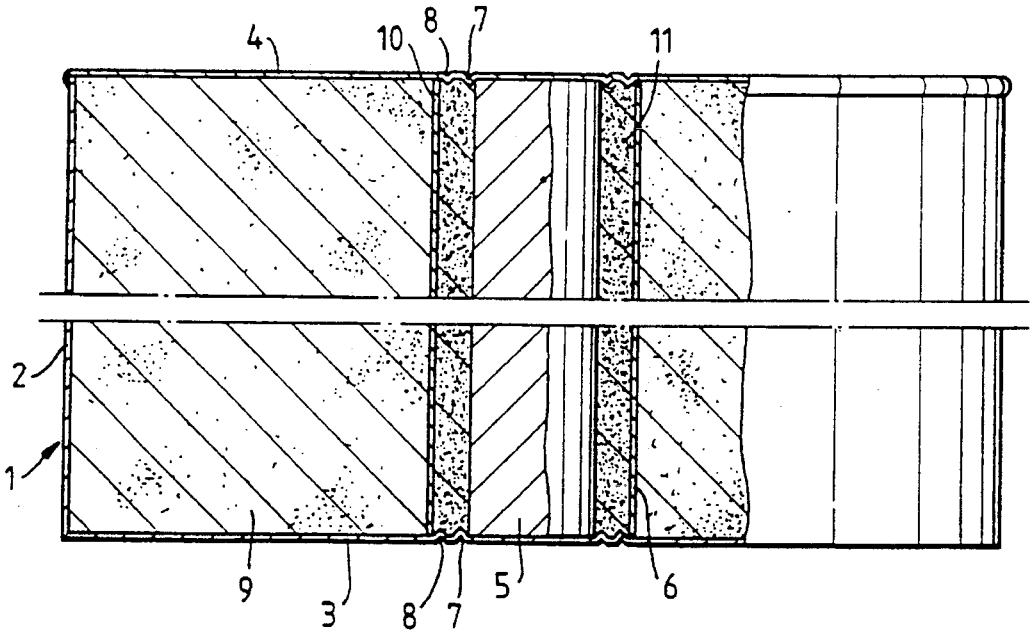

In the drawing; a sheet metal capsule of the kind which conventionally is used for hot isostatic compaction of metal powder generally is designated 1. It consists of a cylindrical wall 2, a bottom 3, and a lid 4 secured by welding. Prior to welding the lid 4 on the capsule, a core 5 is provided in the capsule 1. The core may consist of a steel rod, and coaxially with the core 5 and at a distance from it there is provided a tube 6, suitably a tube made of thin steel sheet. The core 5 and the tube 6 are centred in the capsule 1 by means of suitable means, which according to the embodiment consist of grooves 7, 8 in the bottom 3 and in the lid 4 of the capsule.

When the core 5 and the tube 6 thus have been placed in the capsule 1, the space between the capsule wall 2 and the tube 6 is filled with the metal powder 9, which shall form the desired body having a through hole, and in the annular gap 10 between the tube 6 and the core 5 there is provided a non-metallic powder 11, so that the space 10 is completely filled with said powder. More particularly, the powder consists of dicalcium silicate, $Ca_2SiO_4$ also known as calcium ortosilicate, $(CaO)_2SiO_2$. The capsule 1 which thus is filled, thereafter is covered by the lid 4, which is secured by welding, so that the capsule will be hermetically closed.

The filled and closed capsule thereafter is subjected to hot isostatic compaction and is HIP-ed in a manner which is conventional per se. This treatment is initiated by cold pressing the capsule with content at a pressure of about 400 MPa. Herein the powders 9 and 11 are densified to some degree, which facilitates the subsequent heating. The capsule volume is slightly reduced through the cold pressing operation. Thereafter, the capsule and its content is heated to a temperature exceeding 1000° C., normally to about 1150° C. Thereafter, the capsule and its content is subjected to a pressure from all directions, i.e. an isostatic pressure of about 100 MPa at a temperature above 1000° C., normally about 1150° C. in a hot isostatic pressing press, for example a press of the type which is manufactured by Asea Brown Boeri (ABB) and which is known under its trade name QIH80. Herein the metal powder 9 is consolidated to a completely compact and pore free metal body, and also the dicalcium silicate powder 11 is consolidated to a compact and essentially pore free material.

Normally, the capsule and its content thereafter is allowed to cool, substantially to room temperature or at least to a temperature which makes it possible to handle the object without practical problems. During the cooling, the consolidated dicalcium silicate material tends to expand due to its feature, which is typical for dicalcium silicate, to undergo the above mentioned phase transformation, which causes the dicalcium silicate material to crack (to fragmentize) and more or less return to its initial powder shape. Thereafter the capsule 1 can be opened at least in the region of the dicalcium silicate layer in the bottom 3 and the lid 4, whereafter the core 5 can be pushed out, wherein the dicalcium silicate material which has been fragmented and/or returned to powder form during the cooling operation, works as a release agent between the core 5 and the surrounding, consolidated metal body. After cleaning, the core 5 can be reused. The consolidated metal body, which now is provided with a through hole, possibly after cleaning its exterior and interior surfaces, can be hot worked to desired final dimension. If desired, depending on the application in question, the consolidated metal body can be cut to form desired blanks prior to or after possible hot working.

It is also conceivable to hot work the consolidated material prior to cooling from the HIP-ing temperature and to allow the material to cool thereafter, wherein the dicalcium silicate material is caused to fragmentize and/or to be formed to powder in order to allow a release between the consolidated metal body and the core.

I claim:

1. Method of powder metallurgical manufacturing a body having a through hole, comprising the steps of:

providing in an outer capsule a tube (6) having substantially the same length as the capsule, so that the tube extends substantially through the entire length of the capsule and defines a first space between the tube and an inner side of the capsule (1);

providing in the tube a core (5) which also extends through the capsule and the entire length of the tube and defines a second space between an inner side of the tube and the core;

filling the first space between the tube (6) and the inner side of the capsule (1) with a metal powder (9) for forming a desired body;

filling the second space (10) between the core (5) and the inner side of the tube with a non-metallic powder (11);

closing the capsule hermetically;

compacting the closed capsule and its contents using hot isostatic compaction at a temperature exceeding 1000° C., so that the metal powder is compacted to complete density;

consolidating the non-metallic powder (11) in the second space between the core and the inner side of the tube to an essentially dense material during the hot isostatic compaction, so that it can transfer the isostatic pressure, which is applied to the outer side of the capsule, to the core via the metal powder (9) which is compacted to complete density; and cooling the hot isostatically compacted capsule and its contents and causing the essentially dense material which is formed through the consolidation said non-metallic powder during the hot isostatic compaction to deconsolidate.

2. Method according to claim 1, further comprising the step of hot working the hot isostatically compacted capsule and its content through at least one of forging and rolling before said cooling step.

3. Method according to claim 2, wherein the non-metallic powder (11) has a material related tendency of undergoing a volume change due to phase transformation, causing internal stresses in the non-metallic powder upon cooling from a temperature above 1000° to room temperature.

4. Method according to claim 3, wherein the non-metallic powder comprises dicalcium silicate, $Ca_2SiO_4$.

5. Method according to any of claims 1–3, wherein the tube (6) is selected from the group consisting of a tube made of a metal sheet, a sleeve at least partly made of paper board, and a glass tube.

6. Method according to any of claims 1–3, wherein the metal powder is selected from the group consisting of a steel powder and a powder of a refractory metal, and the core consists of a steel rod.

7. Method according to any of claims 1–3, Wherein the metal powder consists of a high speed steel powder.

8. A method of manufacturing a powder metallurgical body having a through hole, comprising the steps of:

providing an outer capsule and a tube within the outer capsule, a first space being defined between the tube and the outer capsule;

providing a core within the tube which extends concentrically through the tube, a second space being defined between the core and the tube;

filling the first space with a metal powder for forming a desired body;

filling the second space with a non-metallic powder;

compacting the capsule and its contents using hot isostatic compaction at a temperature exceeding 1000° C.;

consolidating the non-metallic powder in the second space during the hot isostatic compaction, so that the non-metallic powder can transfer isostatic pressure to the core; and cooling the hot isostatically compacted capsule and its contents and causing the consolidated non-metallic powder to deconsolidate.

9. The method according to claim 8, wherein the non-metallic powder comprises dicalcium silicate, $Ca_2SiO_4$.

* * * * *